US012303736B2

(12) United States Patent
Cobb

(10) Patent No.: US 12,303,736 B2
(45) **Date of Patent: *May 20, 2025**

(54) EXERCISE APPARATUS WITH INTEGRATED BENCH ASSEMBLY

(71) Applicant: Oxefit, Inc., Plano, TX (US)

(72) Inventor: Tyson Cobb, Pensacola, FL (US)

(73) Assignee: Oxefit, Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/362,227

(22) Filed: Jul. 31, 2023

(65) Prior Publication Data

US 2023/0372764 A1 Nov. 23, 2023

Related U.S. Application Data

(63) Continuation of application No. 17/584,249, filed on Jan. 25, 2022, now Pat. No. 11,813,495.
(Continued)

(51) Int. Cl.
*A63B 21/078* (2006.01)

(52) U.S. Cl.
CPC ..... *A63B 21/078* (2013.01); *A63B 2210/50* (2013.01)

(58) Field of Classification Search
CPC ..... A63B 21/078; A63B 2210/50; A63B 2023/0411; A63B 21/153; A63B 71/0622; A63B 23/03558; A63B 21/4029; A63B 21/063; A63B 21/4034; A63B 21/4043; A63B 22/203; A63B 21/154; A63B 21/0442; A63B 21/152; A63B 22/0087; A63B 21/0552; A63B 21/4035; A63B 23/0494; A63B 23/1218; A63B 23/1281;
(Continued)

(56) References Cited

U.S. PATENT DOCUMENTS 4,431,181 A 2/1984 Baswell
4,691,918 A 9/1987 Rockwell
(Continued)

FOREIGN PATENT DOCUMENTS

CA 1165787 A 4/1984
JP 2017-094063 A 6/2017
(Continued)

OTHER PUBLICATIONS

International Search Report/Written Opinion Dated Jun. 2, 2022 in PCT/US2022/013745.
(Continued)

*Primary Examiner* — Andrew M Kobylarz
(74) *Attorney, Agent, or Firm* — Foley & Lardner LLP

(57) ABSTRACT

A bench assembly includes a bench surface configured to support a user and a support structure coupled to the bench surface and comprising a plurality of pivot points. Pivoting of the support structure at the plurality of pivot points provides for movement of the bench surface between a deployed orientation in which the bench surface is positioned for use during performance of a first exercise and a stowed orientation different from the deployed orientation in which the bench assembly is displaced from the deployed orientation to enable performance of a second exercise without using the bench assembly.

20 Claims, 4 Drawing Sheets

Related U.S. Application Data

(60) Provisional application No. 63/142,776, filed on Jan. 28, 2021.

(58) Field of Classification Search
CPC ..... A63B 2225/09; A63B 23/03566; A63B 23/0482; A63B 23/0211; A63B 22/0076
See application file for complete search history.

(56) References Cited

U.S. PATENT DOCUMENTS

| | | | | |
|---|---|---|---|---|
| 6,471,624 | B1 | 10/2002 | Voris | |
| 6,685,601 | B1 * | 2/2004 | Knapp | A63B 21/0783 482/142 |
| 7,878,958 | B2 | 2/2011 | Hockemeyer | |
| 8,926,480 | B2 | 1/2015 | Lyszczarz | |
| 9,327,160 | B2 | 5/2016 | Tauriainen | |
| 9,884,239 | B2 | 2/2018 | Kay et al. | |
| 10,010,740 | B2 | 7/2018 | Hockridge et al. | |
| 10,806,963 | B2 | 10/2020 | Staten | |
| 11,058,936 | B1 * | 7/2021 | Brasch | A63B 23/1218 |
| 11,446,539 | B1 * | 9/2022 | Brasch | A63B 21/4029 |
| 11,712,598 | B2 * | 8/2023 | Yang | A63B 23/03558 482/94 |
| 11,813,495 | B2 * | 11/2023 | Cobb | A63B 21/153 |
| 2002/0094918 | A1 * | 7/2002 | Gerschefske | A63B 21/4029 482/92 |
| 2007/0037674 | A1 * | 2/2007 | Finn | A63B 21/0628 482/99 |
| 2009/0203505 | A1 | 8/2009 | Kroll et al. | |
| 2012/0058859 | A1 * | 3/2012 | Elsom-Cook | A63B 21/00181 482/4 |
| 2014/0080685 | A1 | 3/2014 | Butler | |
| 2016/0136503 | A1 * | 5/2016 | Heideman | A63B 21/152 482/92 |
| 2017/0113097 | A1 | 4/2017 | Wu | |
| 2018/0229072 | A1 | 8/2018 | Staten | |
| 2021/0077884 | A1 | 3/2021 | De Las et al. | |
| 2021/0138295 | A1 | 5/2021 | Montesalvo et al. | |
| 2022/0062738 | A1 | 3/2022 | Neuhaus et al. | |

FOREIGN PATENT DOCUMENTS

| | | | |
|---|---|---|---|
| WO | WO-88/00850 | A1 | 2/1988 |
| WO | WO-02/056973 | A2 | 7/2002 |

OTHER PUBLICATIONS

Partial Supplementary European Search Report on EP 22746482.3 dated Oct. 29, 2024.
Extended European Search Report on EP22746482.3 DTD Mar. 11, 2025.

* cited by examiner

EXERCISE APPARATUS WITH INTEGRATED BENCH ASSEMBLY

CROSS-REFERENCE TO RELATED APPLICATION

This application is a continuation of U.S. Ser. No. 17/584,249, filed Jan. 25, 2022, which claims the benefit of and priority to U.S. Provisional Patent Application No. 63/142,776, filed Jan. 28, 2021, the entire disclosures of which are incorporated by reference herein.

TECHNICAL FIELD

The present disclosure relates to exercise equipment, for example strength training equipment. In particular, the present disclosure primarily relates to racks and benches for use in performing resistance-training (e.g., weight-training) exercises.

BACKGROUND

In some conventional arrangements, a bench is coupled to a weight rack in a static arrangement. For example, a conventional bench press apparatus typically has a bench coupled in a fixed position relative to a rack which can hold a barbell at one or more heights above the bench. The bench permanently obstructs space in front of the rack and cannot be translated relative to the rack, thus limiting the use of the bench press apparatus to a limited number of exercises. For example, in such arrangements, the bench typically prevents a user from standing in front of the bar to perform a standing exercise.

In other conventional arrangements, a weight rack is provided without a bench (e.g., a conventional squat rack). In some cases, this can require both a person to have access to both the conventional bench press apparatus above and a conventional squat rack in order to perform a desired number of different exercises. In other cases, an independent, movable bench may be moved into position relative to the weight rack by a user when the weight rack is desired to be used with a bench. However, conventional movable benches can be heavy and are often not suited for fine position adjustment. So, it may be difficult or cumbersome to achieve a desired (repeatable, consistent) position of the bench relative to the weight rack (e.g., to center the bench relative to the barbell). Additionally, in a gym setting, it may be difficult for a user to find a bench which is not in use by another athlete in the gym, and movable benches may become scattered in disarrayed positions which interfere with other activities in a gym.

An exercise apparatus which solves these challenges of conventional bench and weight rack arrangements is therefore desirable.

SUMMARY

One implementation of the present disclosure is an exercise apparatus. The exercise apparatus includes a platform including an exercise surface, a rack coupled to the platform and configured to support a barbell at a first end of the platform, and a bench assembly coupled to the platform and configured to move between a deployed orientation in which the bench assembly extends perpendicularly from the rack and is positioned over the exercise surface for use during performance of a first exercise and a stowed or retracted orientation in which the bench assembly is displaced from the exercise surface to enable performance of a second exercise without using the bench assembly.

Another implementation of the present disclosure is a bench assembly. The bench assembly includes a first vertical post defining a first pivot point, a first arm extending from the first pivot point to a second pivot point such that first arm is perpendicular to and rotatable about the first vertical post, a second arm extending from the second pivot point to a distal end of the second arm, wherein the second arm is rotatable about the second pivot point, and a bench surface mounted on the second arm and configured to support a user.

Another implementation of the present disclosure is a method of using an exercise apparatus. The method includes pivoting, relative to a rack supporting a barbell, a bench assembly to a deployed position. The method also includes sitting or lying on the bench assembly while performing a first exercise using the barbell. The method also includes pivoting, relative to the rack, the bench assembly to a stowed position, and standing in a space while performing a second exercise using the barbell, wherein the bench assembly occupies the space in the deployed position.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, an improved exercise apparatus including both a rack for supporting a barbell and an integrated bench assembly are shown, according to example embodiments. The integrated bench assembly is positionable between a deployed or extended position (in which a user can sit or lie on a bench surface for exercising using the bench and the barbell) and a stowed or retracted position (in which the bench assembly is moved out of a space in front of the barbell in order to allow a user to stand and move in the space occupied by the bench assembly in the deployed position). The deployed position can be repeatedly and consistently achieved in order to easily provide a desired, consistent positioning of a bench surface relative to the rack. The stowed position allows for a wide range of exercises to be performed using the exercise apparatus. Together, moving the bench assembly between the deployed and stowed positions allows athletes to quickly and repeatedly switch between a first exercise using a bench and a second exercise not using the bench, while also using the same rack and barbell for both exercises.

Figure 1:
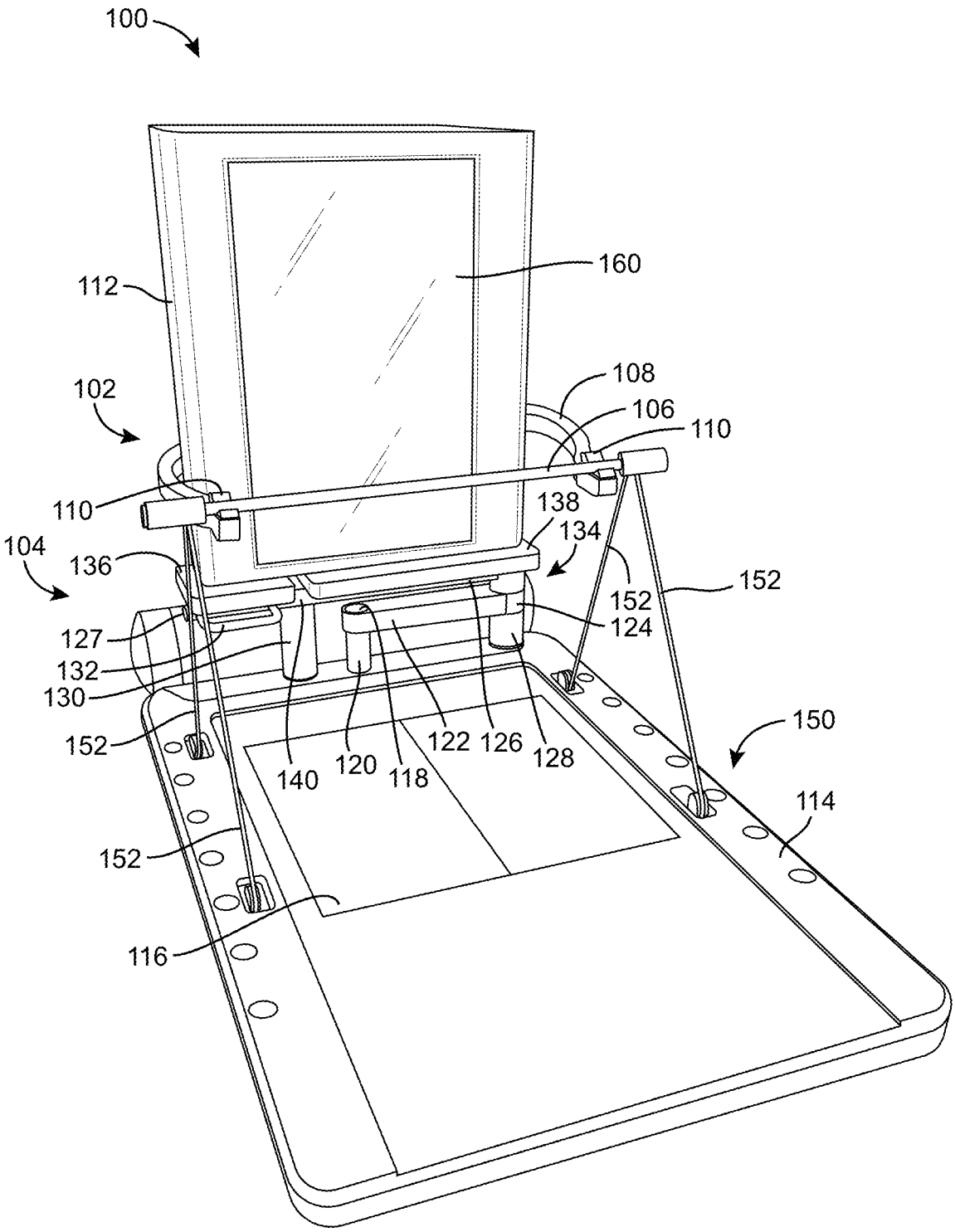
FIG. 1 is perspective view of an exercise apparatus with a rack and an integrated bench assembly, according to an example embodiment.

Referring now to FIG. 1, a perspective view of an exercise apparatus 100 including a rack 102 and a bench assembly 104 is shown, according to an example embodiment. As described in detail below, the exercise apparatus 100 is configured for use in performing a large number of different resistance or strength-training exercises using a barbell 106 supported by the rack 102, including exercises which involve a bench and exercises which do not involve a bench. FIG. 1 shows the bench assembly 104 in a stowed position or state (un-deployed, out-of-use, stored).

In various embodiments, the rack 102 can be any structure (frame, stand, etc.) configured to hold a barbell 106 between exercises performed using the barbell 106. As shown in FIG. 1, the rack 102 includes a frame 108 extending between a pair of cradles 110. The cradles 110 are positioned on a front side of the rack 102 and are configured to receive and support the barbell 106 such that the barbell 106 can be repeatedly removed from and placed back in the cradles 110 as a user performs a workout using the barbell 106. The frame 108 is coupled to a stand 112 which extends in a vertical direction and can define a vertical plane.

In some embodiments, the position of the frame 108 is adjustable along the stand 112 to adjust the height of the cradles 110. The frame 108 may be manually repositionable along the stand 112. In other embodiments, the frame 108 is connected to a motorized drive system which can be electronically controlled to move the frame 108 along the stand 112. For example, the motorized drive system may respond to user input via a force sensor positioned on the frame 108, and may control a motor to move the frame 108 at a velocity determined as a function of the amount of force input by the user. In some such embodiments, the rack 102 includes features described in U.S. Provisional Application No. 63/142,783, the entire disclosure of which is incorporated by reference herein in its entirety.

In FIG. 1, the rack 102 is shown as extending vertically upwards from a base or platform 114 included with the exercise apparatus 100. The platform 114 includes an exercise surface 116 configured and otherwise sized for performance of exercises thereon. The exercise surface 116 can be flat and can include a non-slip surface or a surface which is otherwise adapted for performance of weight-training activities thereon. The rack 102 is positioned at a first end of the platform 114 and holds the barbell 106 proximate a first end of the exercise surface 116. In some embodiments, the platform 114 includes sensors to measure loads exerted thereon during use of the exercise apparatus 100.

The bench assembly 104 is coupled to the platform 114 and the rack 102 proximate an intersection between the platform 114 and the rack 102 and proximate the first end of the exercise surface 116. The bench assembly 104 is movable and/or otherwise pivotable between the stowed state (stowed position, stowed orientation) shown in FIG. 1, where the bench assembly 104 is displaced and/or retracted from the exercise surface 116 beyond the first end of the exercise surface 116, and one or more deployed states (deployed positions, deployed orientations) shown in FIGS. 2-4 in which the bench assembly 104 extends over the exercise surface 116 and under the barbell 106. In the stowed state of FIG. 1, the bench assembly 104 is positioned in an open space defined by the rack 102. In the embodiment illustrated in FIGS. 1-4, the bench assembly 104 includes a first pivot point 118 in fixed relation to the platform 114 and the rack 102, such that pivoting of the bench assembly 104 repeatably and consistently moves the bench assembly 104 between the stowed state and the deployed state, and such that the bench assembly 104 is reliably accessible to a user of the exercise apparatus 100.

In the examples shown herein, the bench assembly 104 includes a first vertical post 120 extending upwardly from the platform 114 outside of the exercise surface 116 but proximate the first end of the exercise surface 116. As shown in FIG. 1, the first vertical post 120 is positioned under the rack 102, for example aligned with a plane defined by the stand 112. The first vertical post 120 defines the first pivot point 118, for example so that an axis of rotation of the first pivot point 118 is the longitudinal center axis of the first vertical post 120. In the example shown, the first vertical post 120 is positioned at a center line of the platform 114 (i.e., approximately half-way across a width of the platform 114).

The bench assembly 104 is also shown as including a first arm 122 extending from the first pivot point 118 (e.g., from the top of the first vertical post 120) in a horizontal direction substantially perpendicular to the first vertical post 120 (and parallel to a plane defined by the exercise surface 116). The first arm 122 can rotate about the first pivot point while remaining substantially perpendicular to the first vertical post 120. The first arm 122 extends from the first pivot point to a second pivot point 124.

The bench assembly 104 is also shown as including a second arm 126 extending from the second pivot point 124 to a distal end 127 of the second arm 126. In the example shown, a second vertical post 128 is provided at the second pivot point 124 to pivotably couple the second arm 126 to the second pivot point 124 while vertically offsetting the second arm 126 from the first arm 122, such that the second arm 126 is higher than the first arm 122 relative to the platform 114. The second vertical post 128 is not directly coupled to the platform 114 and moves relative to the platform 114 as the first arm 122 pivots. Additionally, the second pivot point 124 enables the second arm 126 to pivot relative to the first arm 122 about a vertical axis of the second pivot point 124 while the second arm 126 remains substantially parallel to a plane defined by the platform 114. The first pivot point 118 and the second pivot point 124 thus combine with the first arm 122 and the second arm 126 to provide the bench assembly 104 with a pair of articulating joints to facilitate movement/pivoting of the bench assembly 104 between the stowed and deployed positions.

The bench assembly 104 is also shown to include a third vertical post 130 positioned along and extending downwardly from the second arm 126. The third vertical post 130 is shown as being positioned between the distal end 127 of the second arm 126 and the second pivot point 124, such that a distance between the third vertical post 130 and the second pivot point is greater than a length of the first arm 122. In other embodiments, the third vertical post is positioned at the distal end 127 of the second arm 126. The third vertical post 130 is not directly fixed to the platform, such that the third vertical post 130 moves relative to the platform 114 during articulation and pivoting of the bench assembly 104.

The second vertical post 128 and the third vertical post 130 are configured to provide structural support for the bench assembly 104 by extending from the platform 114 to the second arm 126, while still allowing for easy pivoting of the bench assembly 104. For example, in some embodiments, the second vertical post 128 and the third vertical post 130 include a material at the bottom end thereof which can easily slide along the platform 114. As another example, in some embodiments, the second vertical post 128 and the third vertical post 130 are slightly lifted from the platform 114 when no load is applied on the bench assembly 104, but are brought into contact with the platform 114 when a downward load is applied on the bench assembly 104 (e.g., when a person sits or lies on the bench assembly 104 in the deployed position), thereby providing structural support and avoiding slipping or swaying of the bench assembly 104 when in use. The bench assembly 104 may have a small degree of compliance to allow to enable this behavior. in some cases, the weight of the bench assembly 104 itself is enough to bring the second vertical post 128 and the third vertical post 130 into contact with the platform, and the second arm 126 can be lifted by the user in order to slightly raise the second vertical post 128 and the third vertical post 130 in order to allow pivoting of the bench assembly 104.

Figure 2:
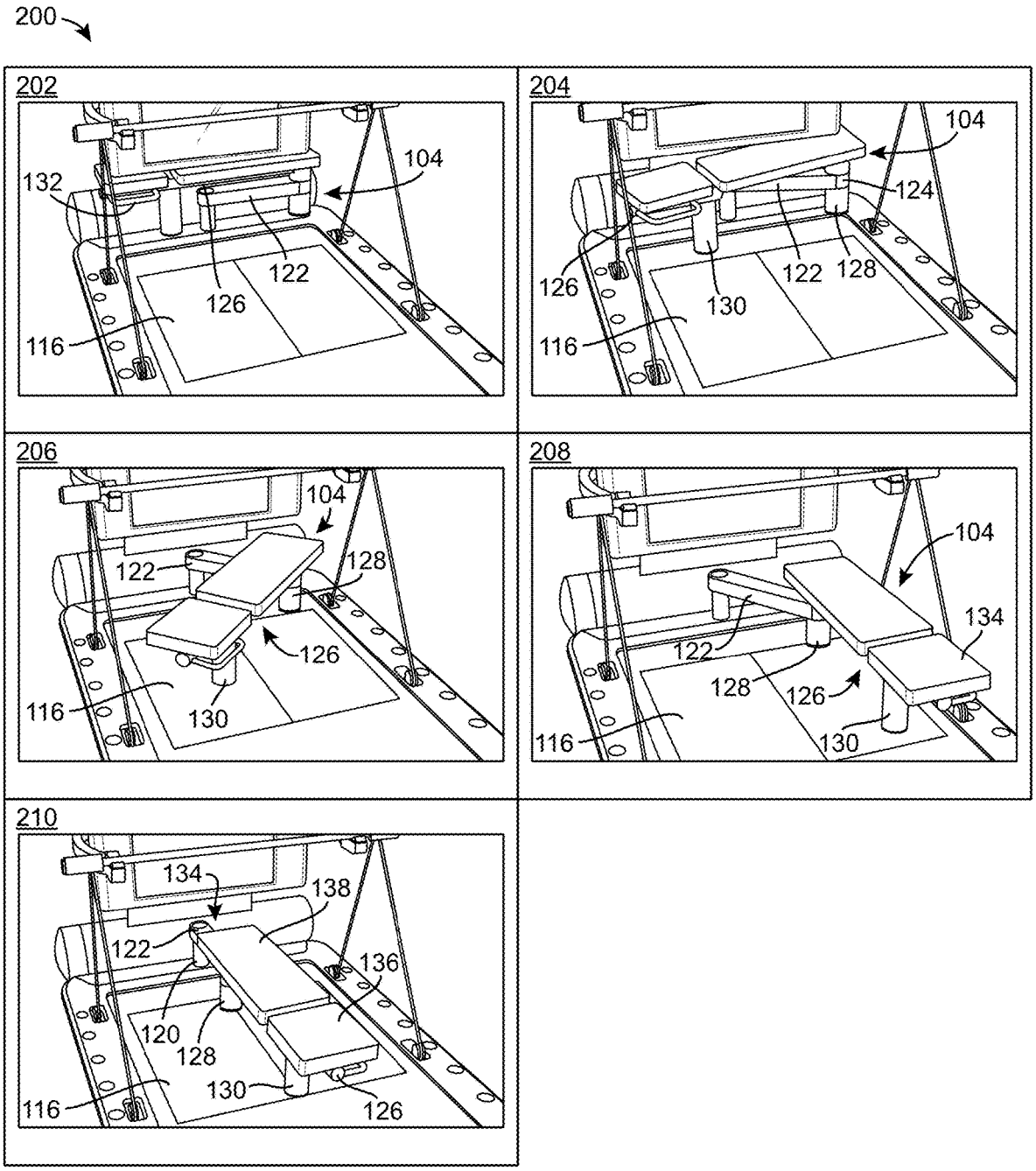
FIG. 2 is a storyboard-style illustration showing pivoting of the bench assembly from a stowed position to a deployed position, according to an example embodiment.
Figure 3:
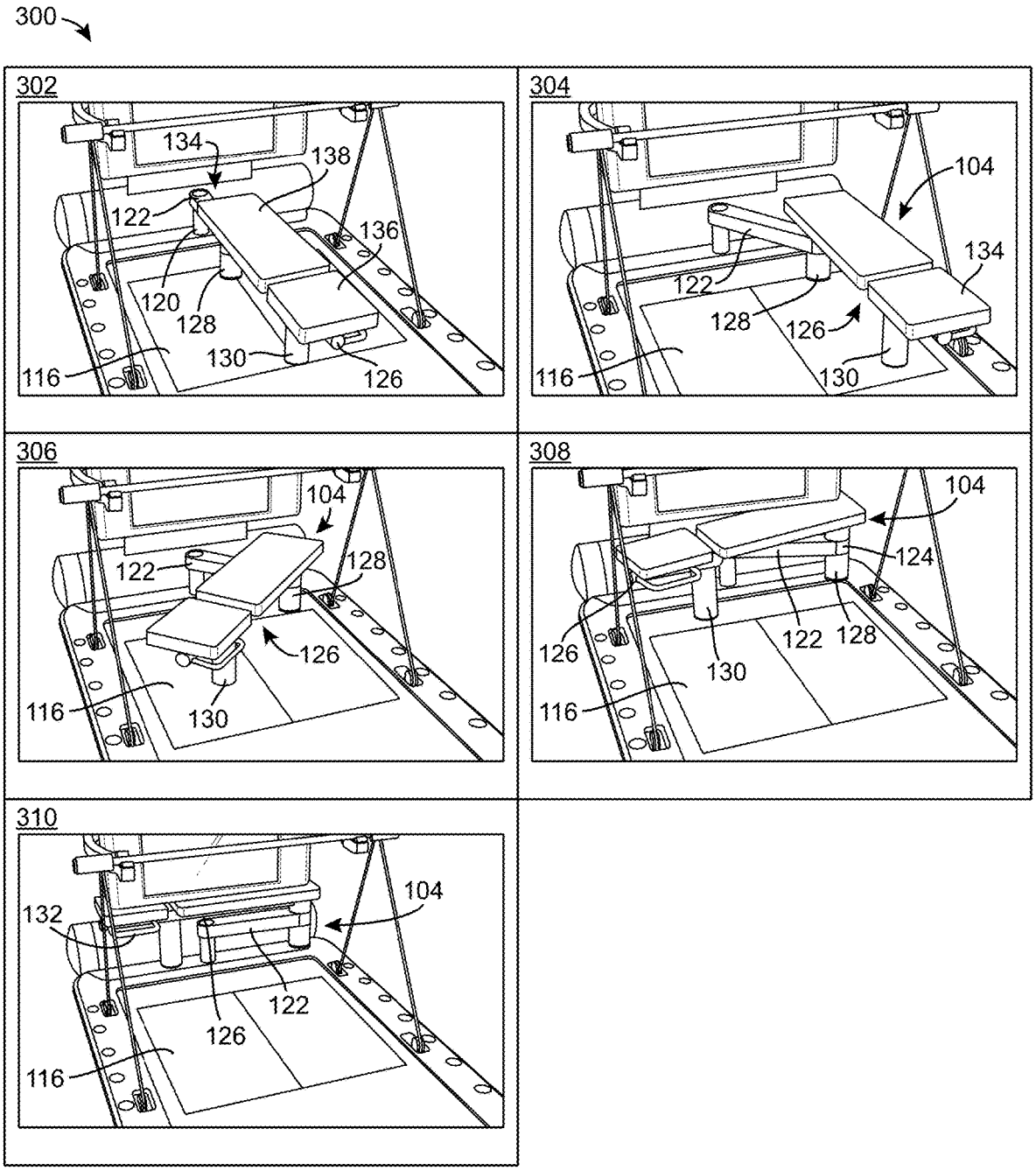
FIG. 3 is a storyboard-style illustration showing pivoting of the bench assembly from the deployed position to the stowed position, according to an example embodiment.

The bench assembly 104 is also shown to include a handle 132 positioned proximate the distal end 127 of the second arm 126. The handle 132 is configured to be held by a user so that the user can manipulate the bench assembly 104, for example to pivot the bench assembly 104. As shown, the handle 132 is positioned on a side of the second arm 126 so that the handle 132 is easily accessible to the user when the bench assembly 104 is in the stowed position shown in FIG. 1. FIGS. 2-3, described in detail below, show articulation/pivoting of the bench assembly 104 between the stowed position and the deployed position, for example by a user engaging the handle 132.

The bench assembly 104 is also show to include a bench surface 134 including a seat portion 136 and back portion 138. The bench surface 134 defines a padded surface on which a person can sit, lie, etc. In some cases, the bench surface 134 is also adapted to be stood upon. The seat portion 136 and the back portion 138 can each include a rigid body providing a flat, rigid structure to the seat portion 136 and the back portion 138, a padded material (e.g., foam), and a covering material (e.g., an easy-to-clean substantially sweat-proof material). The seat portion 136 and the back portion 138 of the bench surface 134 are configured to allow a user to sit or lie on the bench assembly 104 with their pelvis supported by the seat portion 136 and their back supported by the back portion 138 of the bench surface 134.

The bench assembly 104 may also optionally include an inclination mechanism 140. The inclination mechanism 140 is configured to allow the back portion 138 to be rotated relative to the seat portion 136 and the second arm 126 to allow for the inclination of the back portion 138 to be adjusted. For example, a user may which to incline the back portion 138 to perform an incline bench press or shoulder press exercise. The inclination mechanism 140 can include a joint between the back portion 138 and the seat portion 136 and a pin lock to hold the back portion 138 at various inclinations, while the bench assembly 104 is in the deployed position. As shown in FIG. 1, the back portion 138 may be in a flat, zero-inclination position when the bench assembly 104 is in the stowed position. In other embodiments, the bench assembly 104 can be in the stowed position while the back portion 138 is inclined.

As shown in FIG. 1, the exercise apparatus 100 also includes a multi-cable force production system 150 including the barbell 106 held by the rack 102 and multiple (e.g., four) cables 152 coupled to the barbell 106. The multi-cable force production system 150 includes multiple electrical motors or other actuators configured to independently vary the tension in each cable 152 to vary a magnitude and direction of the force provided to a user via the barbell 106. For example, the multi-cable force production system 150 can be configured as described in detail in U.S. patent application Ser. No. 16/909,003, filed Jun. 23, 2020, the entire disclosure of which is incorporated by reference herein.

In other embodiments, the multi-cable force production system 150 is omitted and the exercise apparatus 100 is used with a conventional weight set, for example including the barbell 106 and a set of plates of various weights configured to be selectively mounted on the barbell. In yet other embodiments, the rack 102 is also omitted and the platform 114 and the bench assembly 104 are used together, for example with dumbbells or some other exercise equipment. In yet other embodiments, the platform 114 is omitted, so that the rack 102 and bench assembly 104 enable performance of exercises on a floor surface supporting the exercise apparatus 100.

As shown in FIG. 1, the exercise apparatus 100 also includes a display screen 160. The display screen 160 may show various information relating to a workout plan, user data, operation of the multi-cable force production system, coaching videos, etc. Examples of information that can be displayed and computing resources, sensors, etc. which can enable the display are described in U.S. patent application Ser. No. 16/909,003, filed Jun. 23, 2020, the entire disclosure of which is incorporated by reference herein. In some examples, the display screen 160 can be controlled to display instructions to a user for pivoting the bench assembly to a particular position. As a specific example, the display screen 160 may display an instruction to the user to pivot the bench assembly 104 to the stowed position in response to a determination by a computing system that an exercise not involving a bench (e.g., squat) is next in a workout routine. Similarly, the display screen 16 may display an instruction to the user to pivot the bench assembly 104 to the deployed position in response to a determination by a computing system that an exercise involving a bench (e.g., a bench press) is next in a workout routine.

Referring now to FIG. 2, a storyboard-style illustration 200 of operation of bench assembly 104 is shown, according to an example embodiment. In particular, FIG. 2 shows the bench assembly 104 being pivoted from the stowed position to a deployed position.

In the first frame 202, the bench assembly 104 is in the stowed position as shown in FIG. 1 and described above. The bench assembly 104 is position under the rack 102 and off of the exercise surface 116, with the second arm 126 vertically aligned with and positioned above the first arm 122. A user can grab the handle 132 to initiate the deployment process illustrated in FIG. 2.

As shown in the second frame 204, the bench assembly 104 is being pivoted out of the stowed position. The second arm 126 is being rotated (counterclockwise in the example shown) about the second pivot point 124 to open an angle between the first arm 122 and the second arm 126. The first arm 122 rotates about the first vertical post 120 (clockwise in the example shown). The first arm 122 rotates in an opposite rotational direction around the first pivot point 118 as compared to rotation of the second arm 126 around the second pivot point 124. As a result, both the second vertical post 128 and the third vertical post 130 start to be moved over the exercise surface 116 and away from a plane defined by the rack 102.

As shown in the third frame 206, the bench assembly 104 continues to be pivoted to open the angle between the first arm 122 and the second arm 126 even further. The second arm 126 is being rotated (counterclockwise in the example shown) about the second pivot point 124 to open an angle between the first arm 122 and the second arm 126. The first arm 122 rotates about the first vertical post 120 (clockwise in the example shown). Both the second vertical post 128 and the third vertical post 130 are positioned over the exercise surface 116.

As shown in the fourth frame 208, the bench assembly 104 has been pivoted to a first deployed position, for example a side-deployment position. In the example shown, the bench surface 134 is positioned along a side of the exercise surface 116 and over the exercise surface 116, and the second arm 126 is perpendicular to a plane defined by the rack 102 (and perpendicular to the orientation of the second arm 126 shown in the first frame 202). The first arm 122 is an angle so that the first arm 122 horizontally offsets the second arm 126 from the centerline of the exercise surface 116. For example, an angle between the first arm 122 and the second arm 126 may be approximately 135 degrees. The side-deployment position of the forth frame 208 may be desired for some exercises by a user. A left-side-deployment is shown in the fourth frame 208, and a right-side-deployment can also be achieved in some embodiments. In other scenarios, the position of the fourth frame 208 is part of a transition to the deployed position shown in the fifth frame 210.

As shown in the fifth frame 210, the bench assembly 104 has been successfully pivoted to a deployed position with the bench surface 134 over the bench assembly 104. The angle between the first arm 122 and the second arm 126 have been opened to 180 degrees, so that the first arm 122 is aligned with the second arm 126, and a length of the bench assembly 104 is defined by a sum of the length of the first arm 122 and the second arm 126. The first vertical post 120, the second vertical post 128, and the third vertical post 130 are arranged in series along the centerline of the platform 114, with the second vertical post 128 and the third vertical post positioned on the exercise surface 116. The back portion 138 of the bench surface 134 is positioned under the barbell 106, such that the back portion 138 is between the seat portion 136 and the back portion 138. The bench assembly 104 is horizontally centered between the cradles 110, and is longitudinally aligned for a desired placement relative to the cradles 110 (e.g., a biomechanically-preferred position for performance of a bench press exercise for an average user). In examples including the multi-cable force production system 150, reliable, consistent positioning of the bench may be particularly useful in allowing the multi-cable force production system 150 to provide a desired force profile to a user on the bench. The fifth frame 210 thus shows the bench assembly 104 fully deployed for use in performing an exercise in involving the bench assembly 104 and, in some cases, the barbell 106. For example, a user can sit or lie on the bench surface 134 and then perform an exercise using the barbell 106.

Referring now to FIG. 3, a storyboard-style illustration 300 showing pivoting (articulation) of the bench assembly 104 from the deployed position to the stowed position is shown, according to an example embodiment. The illustration 300 illustrates that the bench assembly 104 can be returned to the stowed position by working backwards through the process shown in FIG. 2.

In the first frame 302 of illustration 300 of FIG. 3, the bench assembly 104 is shown in the deployed position as in the fifth frame 210 of FIG. 2. To begin to stow the bench assembly 104, the second frame 304 shows that the first arm 122 can be rotated around the first vertical post 120 to start to close an angle between the first arm 122 and the second arm 126. The third frame 306 shows that the second arm 126 is also rotated to close the angle between the first arm 122 and the second arm 126, and the fourth frame 308 shows pivoting of the bench assembly 104 approaching the stowed position.

In the example shown, the first arm 122 is rotated counterclockwise and the second arm 126 is rotated clockwise during the stowing process, thereby reversing the deployment process of FIG. 2. In some embodiments, the bench assembly 104 can also be stowed through symmetrical pivoting in the opposite direction, thereby reversing the orientation of the bench assembly 104 in the stowed position as compared to the first frame 202 of illustration 200 of FIG. 2.

The fifth frame 310 shows the bench assembly 104 in the stowed position, with the bench assembly 104 displaced from the exercise surface 116 and having vacated a space occupied by the bench assembly 104 in the deployed position and in which a user can now perform an exercise without interference from the bench assembly 104. The bench assembly 104 is also positioned to not interfere with any other activity in a space around the exercise apparatus 100 (e.g., other athletes moving in a gym). The bench assembly 104 is thereby easily moved into an open space defined by the rack 102 where the bench assembly 104 does not interfere with a user's workout or other people in a gym containing the exercise apparatus 100. Following the steps of FIG. 3, a user can perform an exercise on the exercise surface 116 (e.g., using the barbell 106) without using the bench and while moving in a space formerly occupied by the bench assembly 104.

Figure 4:
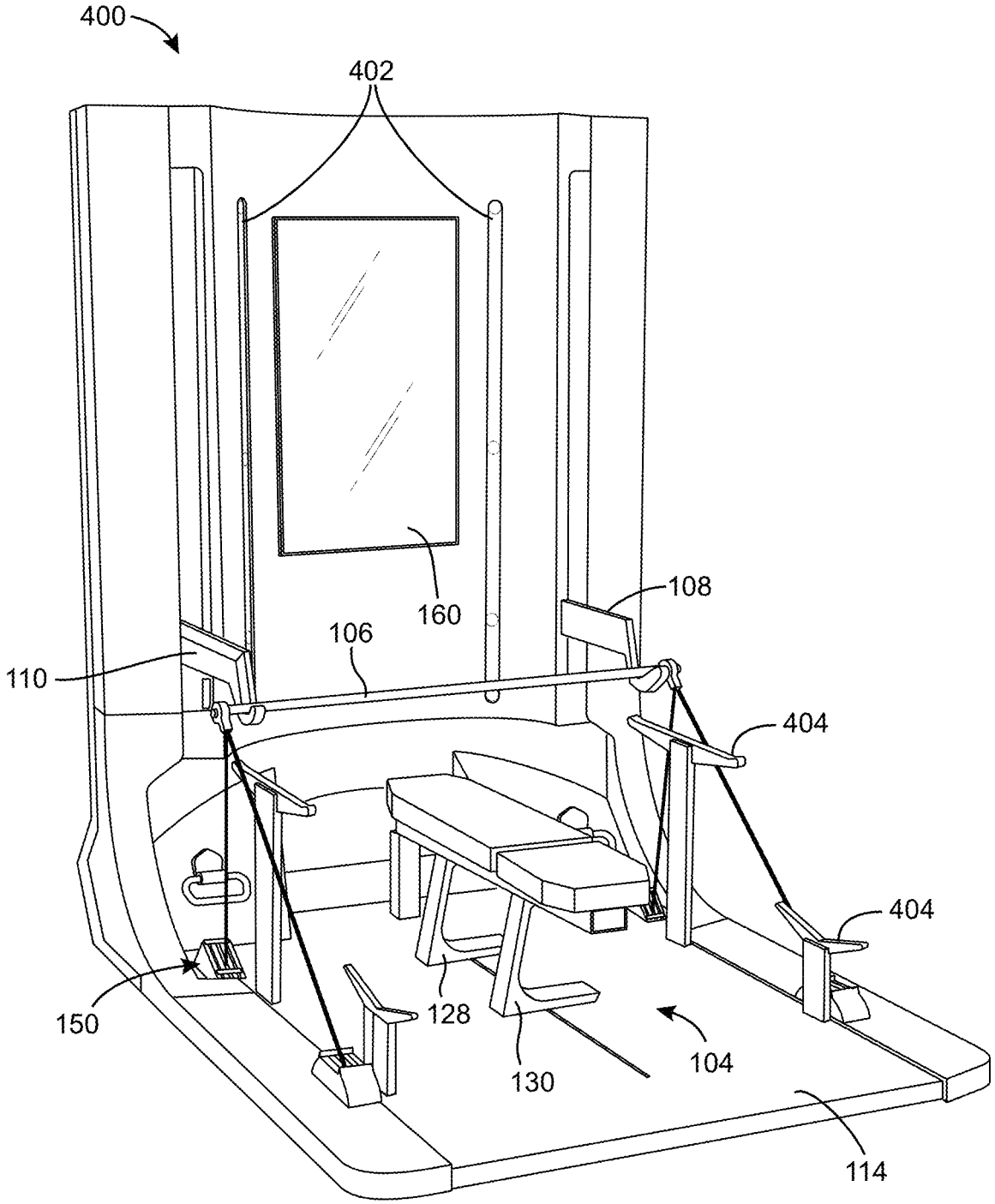
FIG. 4 is a perspective view of a fitness system including an integrated bench assembly, according to an example embodiment.

Referring now to FIG. 4, a perspective view of a fitness system 400 is shown, according to an example embodiment. The fitness system 400 includes an embodiment of the exercise apparatus 100, in addition to additional features and systems configured to provide a full fitness experience, especially a resistance training experience. In particular, the fitness system 400 includes the exercise apparatus 100 described above, the multi-cable force production system 150, a pacing lighting system 402, the display interface 160, and adjustable rails 404.

To start, the example of FIG. 4 shows the bench assembly 104 in an embodiment where the second vertical post 128 and the third vertical post 130 are configured as L-shaped legs. The L-shaped legs can provide additional stability to the bench assembly 104. The vertical posts and other similar terms above should be understood to include members of various geometries, for example the L-shapes of FIG. 4.

The pacing lighting system 402 can be configured as described in detail in U.S. patent application Ser. No. 17/010,573, filed Sep. 2, 2020, the entire disclosure of which is incorporated by reference herein. The pacing lighting system 402 as shown here in FIG. 4 includes a pair of vertically-arranged rows of lighting element configured to illuminate dots (points, circles, areas) of different colors. The dots illuminated on the pacing lighting system 402 can indicate to a user a desired/preferred range of motion for an exercise a real-time indication of the preferred position of the user (showing movement intended to be followed by the user), and a current position of the user (or barbell 106) relative to that range of motion. As shown in FIG. 4, the pacing lighting system 402 can be arranged parallel to a linear path along which the frame 108 can move, such that the pacing lighting system 402 can illuminate points that correspond to heights relative to the frame 108 (and cradles 110). In some embodiments, an additional pacing lighting system 402 is provided at a back end (opposite the display 160) of the fitness system 400 or above the fitness system 400 to be easily visible to a user while sitting or lying on the bench assembly 104.

The fitness system 1000 is also shown as including adjustable rails 404. The adjustable rails 404 are positioned below the cradles 110 and along sides of the platform 114, and are configured to stop the barbell 106 from moving lower than height defined by the adjustable rails 404. The adjustable rails 404 can thus receive the barbell 106 when a user is unable to complete an exercise or otherwise wishes to place the barbell 106 somewhere other than in the cradles 110. For example, the adjustable rails 404 may include low rails adapted for use in a deadlift exercise.

The fitness system 400 can also include various computing and electronics elements and sensors provided therein to provide data-enabled workouts, smart guidance, and integrated control of various actuators, motors, lights, displays, etc. of the fitness system 400. For example, electronics elements as described in U.S. patent application Ser. No. 16/909,003, filed Jun. 23, 2020, and U.S. patent application Ser. No. 17/010,573, filed Sep. 2, 2020, the entire disclosures of which is incorporated by reference herein.

It should be understood that movement between the stowed state shown in FIG. 1 and the one or more deployed states shown in FIGS. 2-4 can be otherwise accomplished. For example, according to other embodiments, the bench assembly 104 can be folded so as to be positioned in a configuration parallel to the display interface 160 when in the stowed position. In such an embodiment, the bench assembly 104 is pivotally secured at the base of the display interface 160 to facilitate movement between the stowed and deployed states. In still other configurations, the bench assembly 104 can be retracted without pivotal movement, such as, for example, being positioned behind the display interface 160. In such a configuration, the bench assembly 104 is movable along a track or other type of guide rail (not illustrated) so as to enable a user to push the end of the bench assembly 104 to move the bench assembly along the track/rail behind the display interface 160.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. A bench assembly, comprising:

a bench surface configured to support a user;

a support structure coupled to the bench surface and comprising a pivot point enabling rotation about an axis, wherein the axis is non-parallel with the bench surface, and wherein pivoting of the support structure at the pivot point provides for movement of the bench surface between:

a deployed orientation of the bench surface in which the bench surface is positioned for use during performance of a first exercise; and a stowed orientation of the bench surface perpendicular to the deployed orientation and in which the bench assembly is displaced from the deployed orientation to enable performance of a second exercise without using the bench assembly.

2. The bench assembly of claim 1, wherein the pivot point is a first pivot point, the bench assembly comprises a second pivot point and an arm extending from the first pivot point to the second pivot point, and the arm is parallel to the bench surface.

3. The bench assembly of claim 2, wherein a first vertical post provides the first pivot point.

4. The bench assembly of claim 3, wherein a second vertical post provides the second pivot point.

5. The bench assembly of claim 4, further comprising a third vertical post coupled to the bench surface and configured to structurally support the bench surface.

6. An exercise apparatus comprising:

a rack configured to support a barbell above an exercise surface; and a bench assembly coupled to the rack and comprising a bench surface, the bench surface configured to support a user and move between:

a deployed orientation of the bench surface in which the bench surface extends perpendicularly from the rack such that the bench surface is positioned over the exercise surface for use during performance of a first exercise; and a stowed orientation of the bench surface perpendicular to the deployed orientation of the bench surface, wherein the bench surface of the bench assembly is parallel with the exercise surface in the stowed orientation.

7. The exercise apparatus of claim 6, wherein the bench assembly comprises a plurality of arms coupled together in series and coupled to the bench surface.

8. The exercise apparatus of claim 7, wherein the plurality of arms are substantially perpendicular to the rack in the deployed orientation and parallel with a plane of the rack in the stowed orientation.

9. The exercise apparatus of claim 6, further comprising a display screen coupled to the rack, wherein the bench assembly is positioned below the display screen in the stowed orientation.

10. The exercise apparatus of claim 9, wherein the bench assembly further comprises:

a first post defining a first pivot point and centered below the display screen;

a first arm extending from the first pivot point to a second pivot point such that the first arm is rotatable about the first post; and a second arm extending from the second pivot point, wherein the second arm is coupled to the bench surface and rotatable about the second pivot point.

11. The exercise apparatus of claim 6, wherein the bench assembly comprises a support structure comprising a vertical pivot point, wherein pivoting at the vertical pivot point enables the bench assembly to move between the deployed orientation and the stowed orientation.

12. The exercise apparatus of claim 6, wherein the bench assembly further comprises:

a first post defining a first pivot point;

a first arm extending from the first pivot point to a second pivot point such that the first arm is rotatable about the first post; and a second arm extending from the second pivot point, wherein the second arm is coupled to the bench surface and rotatable about the second pivot point.

13. A bench assembly, comprising:

a bench surface configured to support a user; and a support structure coupled to the bench surface and comprising a plurality of vertical pivot points, wherein pivoting of the support structure at the plurality of vertical pivot points provides for movement of the bench surface between:

a deployed orientation of the bench surface in which the bench surface is positioned for use during performance of a first exercise; and a stowed orientation perpendicular to the deployed orientation and in which the bench assembly is displaced from the deployed orientation to enable performance of a second exercise without using the bench assembly.

14. The bench assembly of claim 13, wherein the bench surface is configured to be parallel to a floor supporting the bench assembly in both the deployed orientation and the stowed orientation.

15. The bench assembly of claim 13, wherein wherein each of the plurality of vertical pivot points provides for rotation about a respective axis perpendicular to the bench surface.

16. A bench assembly, comprising:

a first post;

a first arm extending from the first post such that the first arm is rotatable about the first post;

a second arm extending from the first arm such that the second arm is rotatable about a pivot point at the first arm; and a bench surface coupled to the second arm and configured to support a user, wherein an axis of rotation of at least one of (i) the first arm about the first post and (ii) the second arm about the pivot point is perpendicular to the bench surface.

17. The bench assembly of claim 16, wherein the first post and the second arm are coupled in series via the pivot point at the first arm.

18. The bench assembly of claim 16, wherein the axis of rotation is vertically oriented.

19. The bench assembly of claim 16, wherein the bench surface is configured to be parallel to a floor supporting the bench assembly throughout a range of rotation of the first arm about the first post and the second arm about the pivot point is perpendicular to the bench surface.

20. The bench assembly of claim 16, wherein a second post provides a second pivot point, the bench assembly further comprising a third post configured to structurally support the bench surface.

* * * * *